United States Patent [19]

Cohen et al.

[11] Patent Number: 4,836,114

[45] Date of Patent: Jun. 6, 1989

[54] SPACE STATION WARDROOM TABLE

[75] Inventors: Marc M. Cohen, Menlo Park, Calif.; Jan Kaplicky, London, United Kingdom; David A. Nixon, Los Angeles, Calif.

[73] Assignee: The United States of America as represented by the Administrator of the National Aeronautics and Space Administration, Washington, D.C.

[21] Appl. No.: 143,416

[22] Filed: Jan. 13, 1988

[51] Int. Cl.[4] ..... A47B 1/04; A47B 57/00

[52] U.S. Cl. ..... 108/77; 108/60; 108/66

[58] Field of Search ..... 108/63, 65, 66, 69, 108/77, 88, 111, 112, 150, 60, 50, 153, 109, 1, 3, 4, 90, 108

[56] References Cited

U.S. PATENT DOCUMENTS

| | | | |
|---|---|---|---|
| 317,288 | 5/1885 | Bowman | 108/3 |
| 470,337 | 3/1892 | Ransom | 108/63 X |
| 2,592,032 | 4/1952 | Henderson | 108/63 X |
| 2,707,662 | 5/1955 | Goldfield et al. | 108/3 X |
| 3,327,656 | 6/1967 | Schwartz | 108/50 |
| 3,685,664 | 8/1972 | Kramer | 108/60 X |
| 3,715,122 | 2/1973 | Brown | 108/50 X |
| 3,844,230 | 10/1974 | Hudson et al. | 108/60 |
| 3,875,872 | 4/1975 | Kayner | 108/1 |
| 3,986,461 | 10/1976 | Steele | 108/60 |
| 4,763,582 | 8/1988 | Rigsby | 108/94 X |

*Primary Examiner*—Kenneth J. Dorner
*Assistant Examiner*—José V. Chen
*Attorney, Agent, or Firm*—Darrell G. Brekke; John R. Manning; Charles E. B. Glenn

[57] ABSTRACT

A table top for use in constricted areas has a plurality of support arms abutting at one end to form a hub. The support arms are arranged in equidistant, spaced-apart relation to each other at the ends distal to the hub. A plurality of work surface leaf sections mounted between the support arms are individually pivotable through 360 degrees about their longitudinal axes. The table top additionally has a plurality of distal leaves, each distal leaf being attached to the distal end of one of the arms. The distal leaves are pivotable between an upright position level with the support arms and a stored position below the support arms.

18 Claims, 11 Drawing Sheets

SPACE STATION WARDROOM TABLE

ORIGIN OF THE INVENTION

The invention described herein was made in the performance of work under a NASA contract and is subject to Public Law 96-517 (35 U.S.C. 200 et seq.). The contractor has not elected to retain title to the invention.

TECHNICAL FIELD

This invention relates to an expandable table top and table for use in constricted areas. More particularly, this invention relates to a novel apparatus for conducting group working, dining, recreational and social activities in a microgravity environment of a pressurized, habitable spacecraft module. More particularly, it relates to an improved table top and table for a space station wardroom which will be the center of such group crew activities on board a space station or other microgravity environment. Most especially, it relates to a table apparatus that adjusts and reconfigures to accommodate crew user groups of different numbers and diurnal shift sizes, to accommodate anthropometrically crew members of different sizes and to accommodate ergonomically a wide range of activities by both individuals and groups of space crew members in a microgravity environment.

BACKGROUND ART

The first wardroom tables were part of sailing ships in the 17th, 18th and 19th centuries. Wardrooms served as the place where the ship's officers gathered for meals and meetings, where they received guests and entertained. When the ship prepared for battle, the crew would sprinkle sand on the floor of the wardroom to provide better footing when wet with blood, and the wardroom table would serve as an operating table in the temporary surgery. Thus, from the earliest applications, the wardroom and its table has been a multipurpose facility.

However, the changes in use of the wardroom and its furnishings in the old sailing ships did not involve changes in the configuration of the table itself, and never were there any ergonomic or anthropometric considerations beyond the most normative rules of thumb. The typical wardroom table was a simple rectangular surface with curbs of a few inches in height to prevent plates, cups and silverware from sliding off in rolling seas. In the 19th century, a few tables were built into gimballed frames which allowed them to remain relatively level while the ship rolled and pitched.

However, this gimballing arrangement did not enhance the anthropometric or ergonomic accommodations and in fact militated against these considerations for the individual crew members as the table would apppear to swing relative to the ship's movements, in order that the food and beverages remain on a fairly level surface and not spill.

Wardroom tables have been part of the manned systems support of two prior space stations, the US Skylab, which flew in 1973, and the Soviet Mir, which was launched in 1986. Both these tables designs are static, fixed and passive and attempt to meet anthropometric neutral body posture requirements principally by embodying dimensional comprises to suit the range of crew member sizes and crew activities that were anticipated to fly on each of these spacecraft.

The Skylab table consisted of three rectangular tops oriented at 120 degrees apart to accommodate the three crew members that would occupy the Skylab at one time [Skylab Experience Bulletin No. 18 entitled "Evaluation of Skylab 1VA Architecture", December 1975, Johnson Space Center Report No. 09552, page 11, FIG. 7]. Recessed into the surfaces of these tops were receptacles to hold food containers and restrain them from floating away.

On Mir, the table is a long, flat rectangle, attached at one end to an interior bulkhead. The table surface is made up of several storage compartment lids which hold various tools and implements. There is a row of receptacle openings along each of the long edges of the Mir table to restrain food containers, but they appear to be intended more for short-term stowage than for convenient eating [Aviation Week & Space Technology, July 20, 1987 Issue, pages 58–60]. This arrangement suggests that the primary purpose of the Mir table is to serve as a work bench, at which eating may be considered as a secondary function.

On commercial airliners, each passenger seat is outfitted with a tray table that generally either deploys out from a recess in the back of the seat in front of the passenger or deploys, pivots and unfolds from the armrest of the passenger's seat. These airline tray tables are designed to provide limited working, eating and drinking accomodations to individual passengers on realtively short duration trips which rarely last in excess of 15 or 20 hours on the same aircraft.

In addition to the above prior art, there is a substantial body of prior art dealing generally with the construction of tables. For example, the following issued U.S. patents disclose various forms of tables having changeable configurations or other special features and to related apparatus: U.S. Pat. No. 1,618,523, issued Feb. 22, 1927 to Feldman et al.; U.S. Pat. No. 1,735,535, issued Nov. 12, 1929 to Feldman; U.S. Pat. No. 1,781,602, issued Nov. 11, 1930; 2,014,745, issued Sept. 17, 1935 to Regli; U.S. Pat. No. 2,322,039, issued June 15, 1943 to Greitzer; U..S. Pat. No. 2,394,866, issued Feb. 12, 1946 to McClune; U.S. Pat. 2,517,018, issued Aug. 1, 1950 to Nicholson; U.S. Pat. No. 3,123,935, issued Mar. 10, 1964 to Williams; U.S. Pat. No. 3,198,145, issued Aug. 3, 1965 to Duncan; U.S. Pat. No. 3,361,508, issued Jan. 2, 1968, to Chassevent; U.S. Pat. No. 3,512,740, issued May 19, 1970 to Podwalny; U.S. Pat. No. 3,875,872, issued Apr. 8, 1975 to Kayner; U.S. Pat. No. 3,877,668, issued Apr. 15, 1975 to Von Sande; U.S. Pat. 4,050,549, issued Aug. 9, 1977 to Sadler; U.S. Pat. No. 4,387,650, issued June 14, 1983 to Pizzi; U.S. Pat. No. 4,579,311, issued Apr. 1, 1986 to Spranza. However, none of these patents disclose a table which will meet the needs of the multipurpose table for a wardroom in a space station or similar confined environment.

The principal disadvantages of the prior art stem from the circumstance that they appear to have been designed from the perspective of serving a very limited range of anthropmetric sizes and ergonomically narrow notions of activities. The Skylab table was designed and built before NASA had any solid information on neutral body posture, in fact virtually all of our microgravity and neutral body posture data come from the Skylab program [Skylab Experience Bulletin No. 17 entitled "Neutral Body Posture in Zero-G, July 1975, Johnson Space Center Report No. 09551, page 21]. The Mir table appears to be equally oblivious to neutral body posture data, but this is probably because it is intended as such a generally purpose work-bench that a flat, fixed surface is the lowest common denominator practical design solution.

Neither the Skylab nor the Mir tables, nor any of the tables disclosed in the above mentioned United States patents, provide dynamic accommodations for variations in crew size, activities or viewing orientations. Neither table adjusts to accommodate differences in anthropometric size or ergonomic differences due to the characteristics of different activities such as eating, writing, working on a computer or conducting a meeting or videoconference. Neither table is designed to fold or stow out of the way easily to allow passage of large objects.

In case of the airline passenger tray table, the design is intended for short term service to one passenger. The airline tray table is not intended to enhance social or group communication with the other passengers and in fact may make it more difficult. These tray tables also make passenger movement extremely difficult and after being served a passenger generally must remain captive in his seat until a flight attendant clears away the debris of his meal. Because these tray tables are extremely confining, uncomfortable and inconvenient for the passengers to use, and do not accommodate and anthropometric adjustments to different sizes of people or ergonomic adjustments for different types of tasks or activities, they are not suitable for a long duration space mission in a microgravity environment.

SUMMARY OF THE INVENTION

General Purpose of the Invention

The space station wardroom table represents the first effort to take a comprehensive architectural design approach to the problem of group activity ergonomics for space station crew members in the space station wardroom. This multi-purpose table will support crew meetings, meals and work activities. The table is designed for use in a pressurized, habitable microgravity by a crew from one to 8 persons. The table top can be configured to accommodate the nominal crew shift size of 4 crew members for daily use and has extension surfaces to provide expansion that will accommodate both crew shifts at one time for a total of eight crew members around the table at equal distances from the center.

A table top for use in constricted areas in accordance with the invention has a plurality of support arms abutting at one end to form a hub. The support arms are arranged in equidistant, spaced-apart relation to each other at the ends distal to the hub. A plurality of work surface leaf sections mounted between said support arms are individually pivotable through 360 degrees about their longitudinal axes. The table top preferably additionally has a plurality of distal leaves, each distal leaf being attached to the distal end of one of the arms. The distal leaves are preferably pivotable between an upright position level with the support arms and a stored position below the support arms.

The table top is dynamic in operation with individual work surfaces that crew members can unfold manually and adjust to suit various crew group sizes, types of operational use, and physical and visual comfort preferences. These dynamic features of work surface deployment and rotation or tilt accommodate the wide range of tasks and activities that would be carried out by the space station crew, each of which has different anthropometric, ergonomic and neutral body postural implications. The table can be folded up at the center post to stow out of the way if a large piece of equipment must be moved through the wardroom.

The wardroom table top reconfigures to accommodate a wide range of crew activities including eating, meetings, planning and scheduling sessions, training sessions, videoconferences, entertainments such as viewing videotapes, observations out the windows in the wardroom and use of individual work stations. The reconfiguration capability is a result of the synergism between the extension of the expansion surfaces and their rotation or tilt capability. The deployment mechanisms are simple and easy to operate.

The primary design objectives for the wardroom table are to provide a compact, efficient and safe design which is responsive to the fluctuating need for up to 8 crew positions and which must function comfortably and easily in the weightless environment. Secondary design objectives are to integrate functional support features including task lighting, storage pockets, object-/implement restraints, handholds/push-offs and data/-communications controls and interfaces.

DETAILED DESCRIPTION OF THE INVENTION

Identification of Component Parts & Explanation of Mode of Operation

The wardroom table of the present invention is comprised of parts that can be assembled or disassembled easily in less than an hour. The entire table can be packed in a shipping case 20"×20"×56". In a preferred form, the wardroom table is lightweight and easily transportable, with the entire shipping unit, with case weighing 48 kg.

WARDROOM AND WARDROOM TABLE ENSEMBLE

Figure 1:
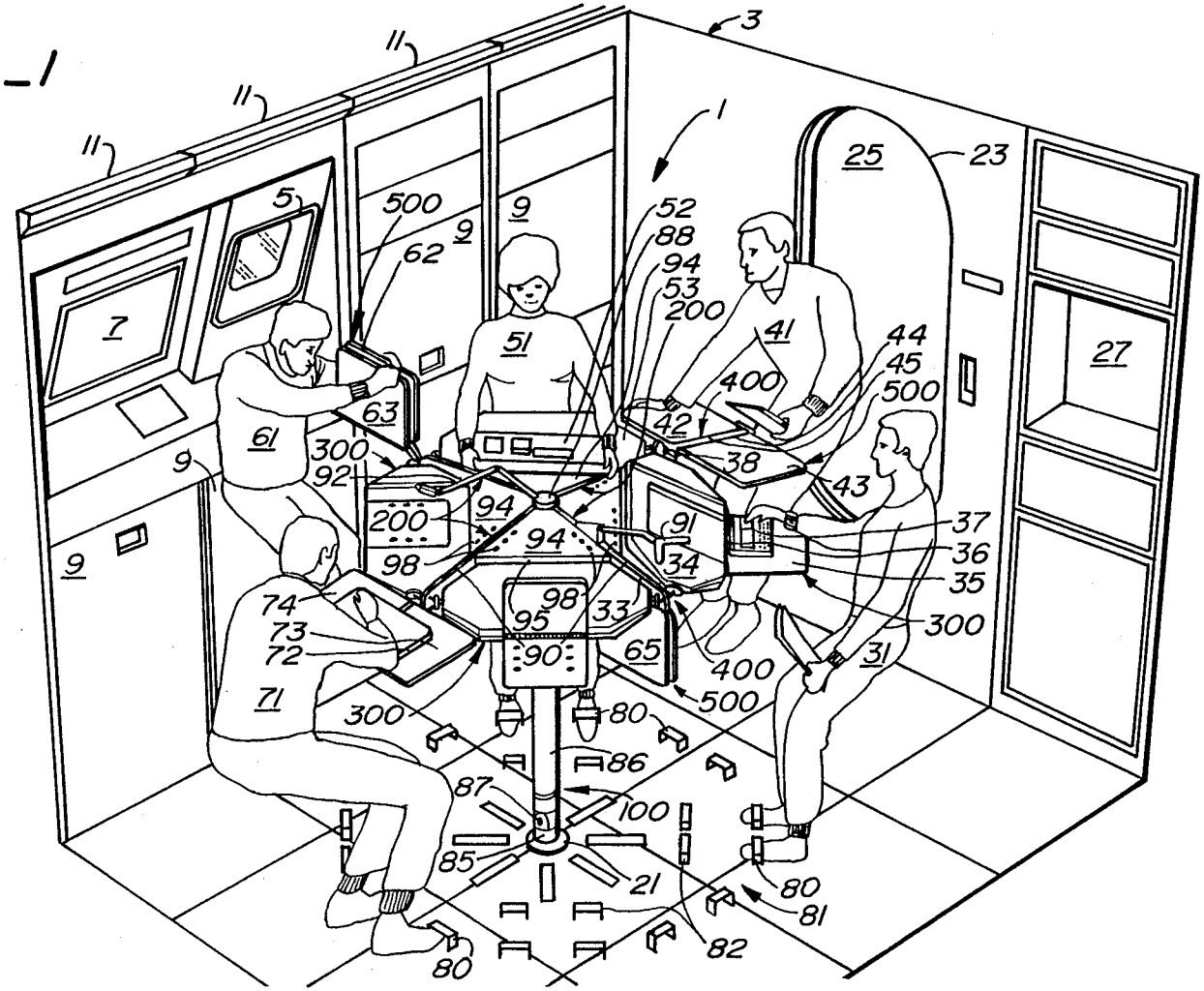
FIG. 1 is an isometric view of a wardroom table system installed in a space station wardroom in accordance with the invention.

Turning to FIG. 1, the complete wardroom table assembly 1 is shown installed in a space station wardroom 3. The wardroom is outfitted furnished with such amenities as windows 5, a flat panel video display screen 7, stowage compartments 9, and lighting elements 11. This wardroom ensemble is installed within a space station pressurized space station module which typically takes the form of a cylindrical pressure vessel (not shown). The wardroom ensemble component racks, floors and ceiling are mounted to the structural pressure vessel shell by means of a structural standoff (not shown). The wardroom floor 17 attaches to these standoffs to provide a structural span to which the wardroom table base may be secured. The wardroom communicates through one or more bulkhead doorways or hatchways 23 with an adjacent compartment such as the exercise facility 25. Adjacent to the wardroom 3 is the galley 27 which provides food storage and preparation facilities including a freezer, refrigeration, heating or warming oven, dish and utensil storage and washing facilities, clean-up and waste disposal accommodations.

FIG. 1 shows a view of the space station wardroom table 1 being used by several crew members at the same time. The crew have positioned the table work surfaces in their several deployed, working and stowed positions. These surfaces and their positions relate to how the crew members are using them looking at the crew members in counterclockwise sequence as follows:

Crew member 31 is using a primary work surface assembly 300, which is mounted between the primary support arms subassemblies 200. Primary work surface subassembly 300 is comprised of two surfaces, the octagonal primary work surface 34 and the rectangular primary work surface extension leaf 35, which connects to the octagonal primary surface by means of a piano hinge 36. Crew member 31 is operating a small portable work station or computer 37 which is restrained temporarily to the deployed rectangular extension leaf 35.

Crew member 41 has just completed deploying secondary support arm subassembly 400 and secondary work surface assembly 500 which consists of the right and left rectangular secondary work surfaces tops 42 and 43 which connect by piano hinges 44 to the secondary extension arm 45 which pivots from the cambracket joint mechanism 38 which is part of the secondary support arm assembly 400 at the end of the primary support arm 33.

Crew member 51 is placing a food tray 52 on an octagonal primary work surface 53 to which it will be passively restrained by the restraint devices f(not shown). She has rotated work surface 53 so that the reverse side from the one chosen by crew member 31 is facing up, that is, the one without the recessed deployable primary work surface extension leaf corresponding to 35.

Crew member 61 is deploying secondary work surfaces 62. He has operated the cam bracket locking mechanism to pivot surfaces 62 about 180 degrees from its stowed position for which the stowed position 65 of secondary support arm subassembly 400 and secondary work surface subassembly 500 is typical, shown at the diagonally opposite corner of the table from secondary work surfaces 62 and 63. Next, crew member 61 will unfold the hinged half tops 62 and 63 which open to form a flat surface similar to 42 and 43 and 73 and 74.

Crew member 71 is eating a meal from a tray 72 which is temporarily restrained to secondary work surface 73 which is deployed in flat a position.

Observe that crew members 31, 51 and 71 each have their feet inserted in a pair of foot restraints 80 in the outer ring 81 of eight foot restraints which correspond to the eight positions for the full space station crew at the wardroom table 1. In addition to the outer ring of pairs of restraints 80 there is an inner ring of four pairs of foot restraints 82 which correspond to the four crew positions for the nominal diurnal crew shift of four crew members.

The table top configuration is mounted to the floor by means of a center post subassembly 100, which is comprised of a base plate 21, straight cylindrical pipe sections 85, a telescoping center section 86 which provides for height adjustments and one or more clevis joint mechanisms 87 which allow the center post subassembly 100 to be folded up so that the table can be stowed out of the way if the crew needs to move a large piece of equipment through the wardroom. The top of the center post is closed off by center post cap 88.

Additional accessories, which are shown attached to the wardroom table at the top open slot 90 in the top of primary support arm subassembly 200, include a handhold body restraint 91 and an adjustable and pointable task light 92. Mounted between the primary support arm subassemblies 200 adjacent to the center post top cap 88 is a triangular utility connection support panel 94. Restrained temporarily on one of these panels 94 facing directly this view of the wardroom is a calculator 95. Other functions of these utility connection panels include providing mounting receptacles or openings for electrical power, computer data system, communications system, audio systems, video system, compressed utility gases such as compressed air or nitrogen, a fiber optic heliostat and liquid beverage dispenser connections, shown as sockets 98.

TABLE SUB-ASSEMBLIES

The wardroom table parts may be described in five groups or sub-assemblies, each of which is closely integrated. The assembly process primarily involves combining the 5 subassemblies. These subassemblies are: The post subassembly [100 series], the primary arm subassembly [200 series], the primary work surface subassembly [300 series], the secondary arm subassembly [400 series]and the secondary work surface subassembly [500 series].

Figure 2:
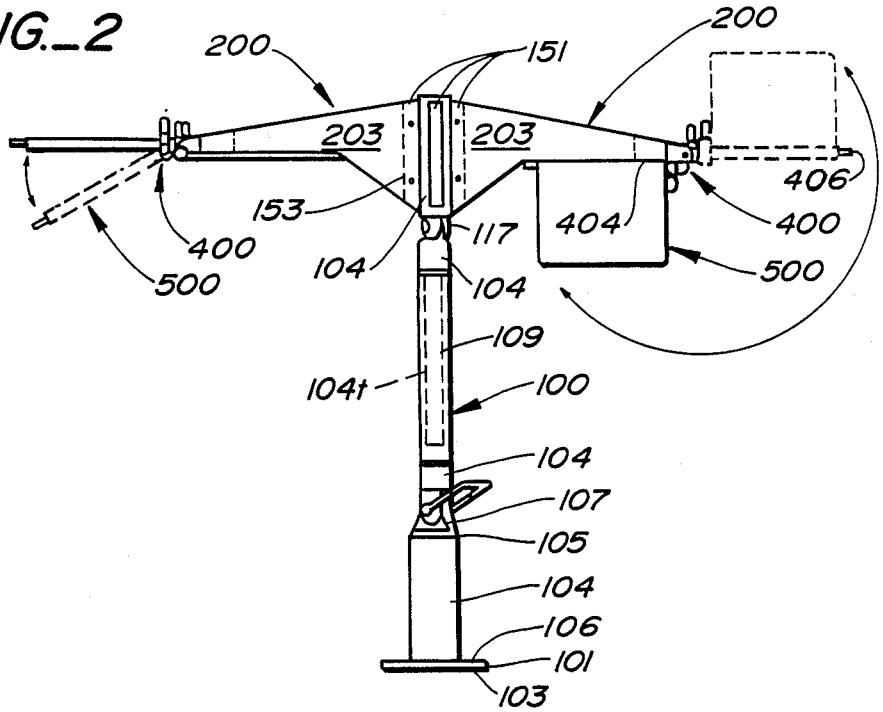
FIG. 2 is a side view of the wardroom table system in upright position shown in FIG. 1.
Figure 3:
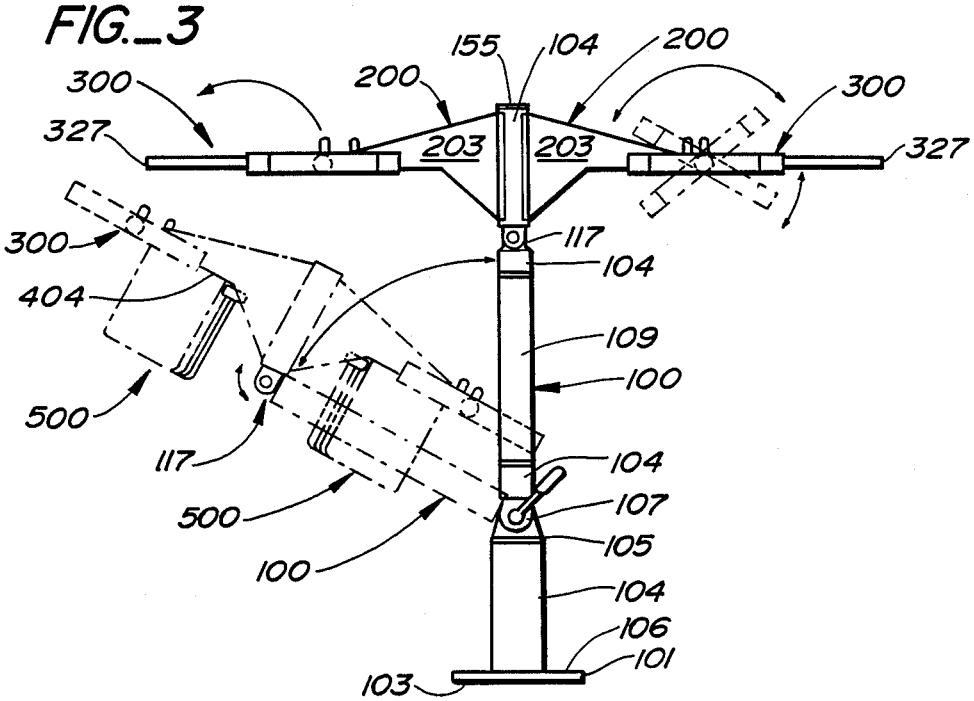
FIG. 3 is a side view of the wardroom table system folded at the centerpost clevis joints into a partially stowed position as an alternate arrangement from that shown in FIGS. 1–2.

Turning to FIGS. 2 and 3, FIG. 3 shows the deployment of the center post mechanism and FIG. 2 shows the table in its upright position. In FIG. 3, it can be seen that center post subassembly 100 can be folded up at the two clevis joints 107 and 117 to allow passage of a large piece of equipment through the wardroom. In FIG. 2, the picture plane is orthogonal to the primary support arms subassemblies 200 and in FIG. 3, the picture plane is orthagonal to the primary work surface 321 subassemblies 300 which are mounted at 45 degrees in plan from the outer ends of the primary support arms 200.

The primary support arms subassemblies 200 is shown in both section and elevation views attached to the center post subassembly 100. FIG. 3 illustrates the rotational movement of the primary work surface subassembly 300 and the deployment of the primary work surface extension leaves 327. FIG. 2 shows the secondary support arm subassembly 400 in its two principal positions, stowed position 404 and pivoted about 180 degrees to the deployed position 406. FIG. 2 also shows the secondary work surface assembly 500 in its two positions also, folded and deployed position. In FIG. 3, where entire wardroom table assembly 1 is shown in stowed a position, the center post assembly 100 is shown in partly folded position, the primary work surfaces 300 are shown in horizontal position with the primary work surface extension leaves 327 folded to stow in their recesses, the secondary arm assemblies 400 are pivoted to stow in position 404 under the primary support arm assemblies 200 and the primary work surfaces 500 are locked in folded position.

CENTER POST SUB-ASSEMBLY

The center post assembly, best seen in FIGS. 2–3, is composed of several moving and fixed parts including a base plate 101, upper and lower parts formed by straight cylindrical tube sections 104, lower and upper joints or clevis joint mechanisms 107 and 117, and a middle part formed by telescoping center section mechanism 109 and welded gusset plates 151. The middle part 109 is hollow and receives a telescoping tube 104t on the upper part.

The post baseplate 101 attaches to bolt holes 106 at an attachment hard point in the wardroom floor deck by means of four bolts (not shown). A section of cylindrical tubing 104 is welded as a post stub to the baseplate 101 at its bottom end 103 and at its upper end 105 is open to receive the clevis joint mechanism 107. Above clevis joint mechanism 107 is telescoping section 109 that allows adjustment of the height of the table. Above telescoping section 109 is a second clevis joint mechanism 117.

Above clevis joint 117, 4 aluminum plate gussets 151 are welded to a straight section of the standard diameter center post tube 104. Each of the gussets 151 are drilled with two or more holes 153 which serve as cantilever connection points. At the very top end of center post tube 104 is a plug cap 155 which is the same as 88 in FIG. 1.

PRIMARY SUPPORT ARM ASSEMBLY

Figure 8:
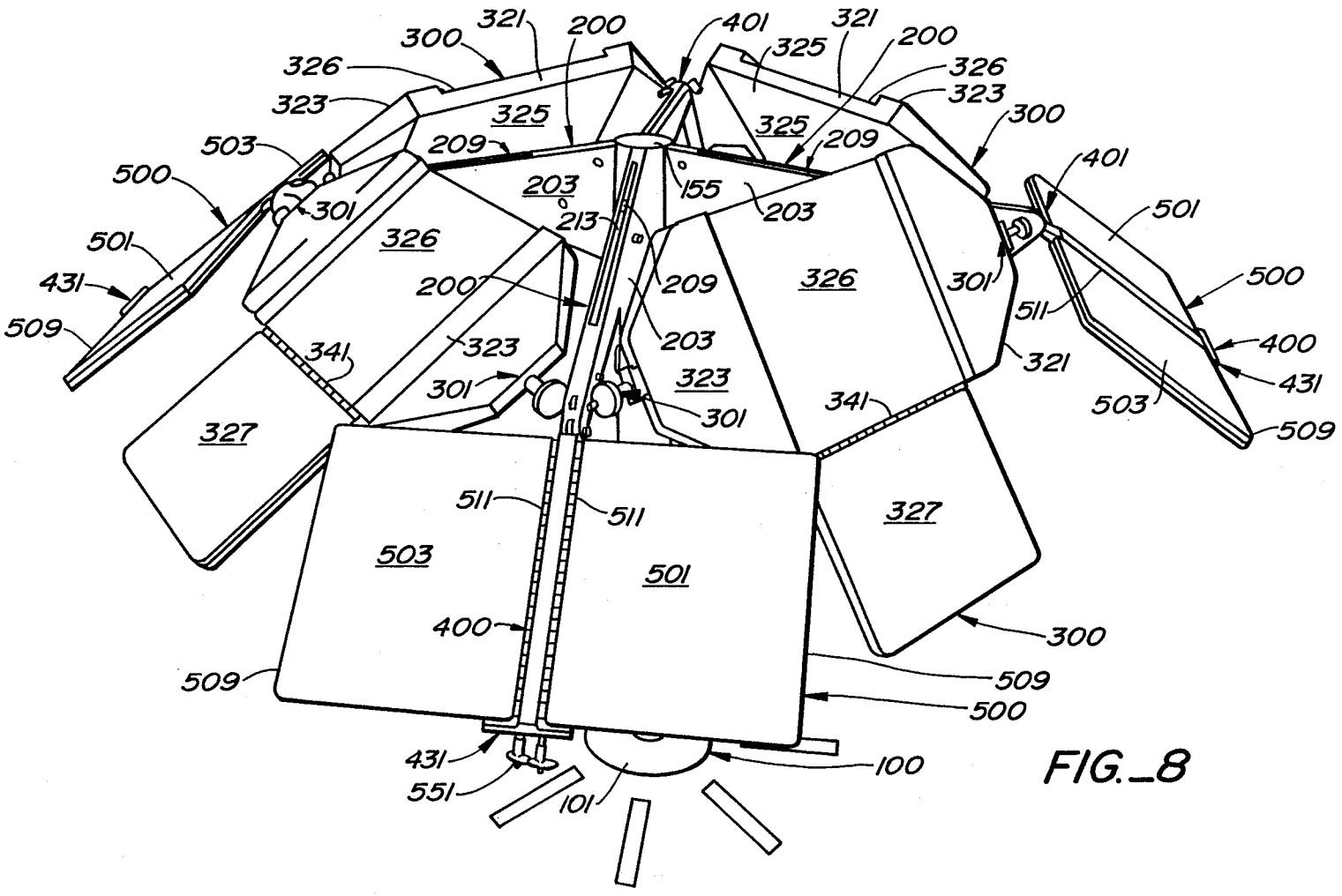
FIG. 8 is a perspective view of the wardroom table system in another arrangement for eight crew members.
Figure 14:
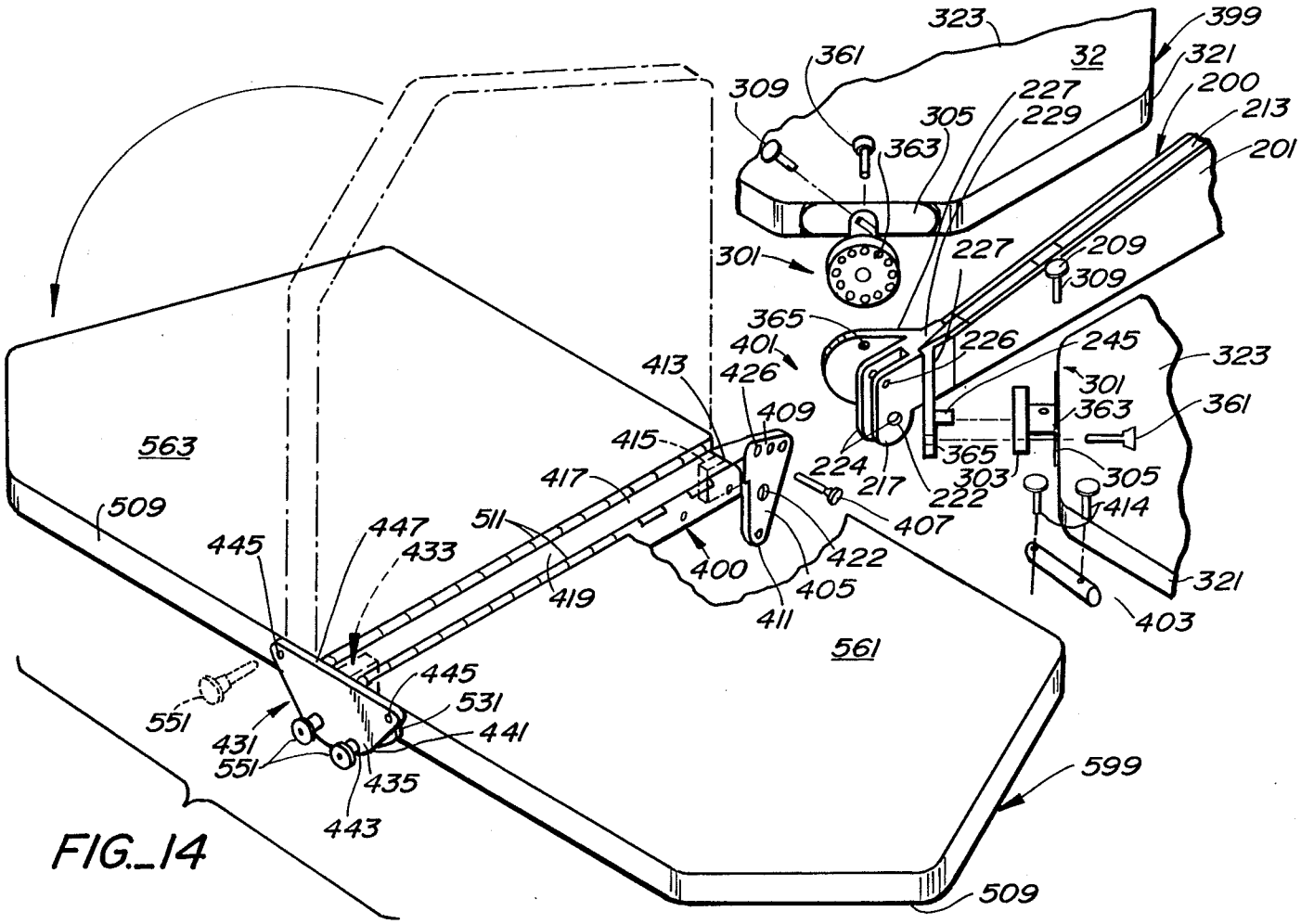
FIG. 14 is an exploded perspective view of a portion of the wardroom table system of FIGS. 10–13.

The primary support arm assembly is best illustrated in FIGS. 8—8 and 14. The primary support arm subassembly 200 is comprised of all fixed parts, including the double plate support arms 201 with spacer blocks 209, the right and left hand primary surface rotation brackets 227 and the bifurcated arm extension 217.

Figure 10:
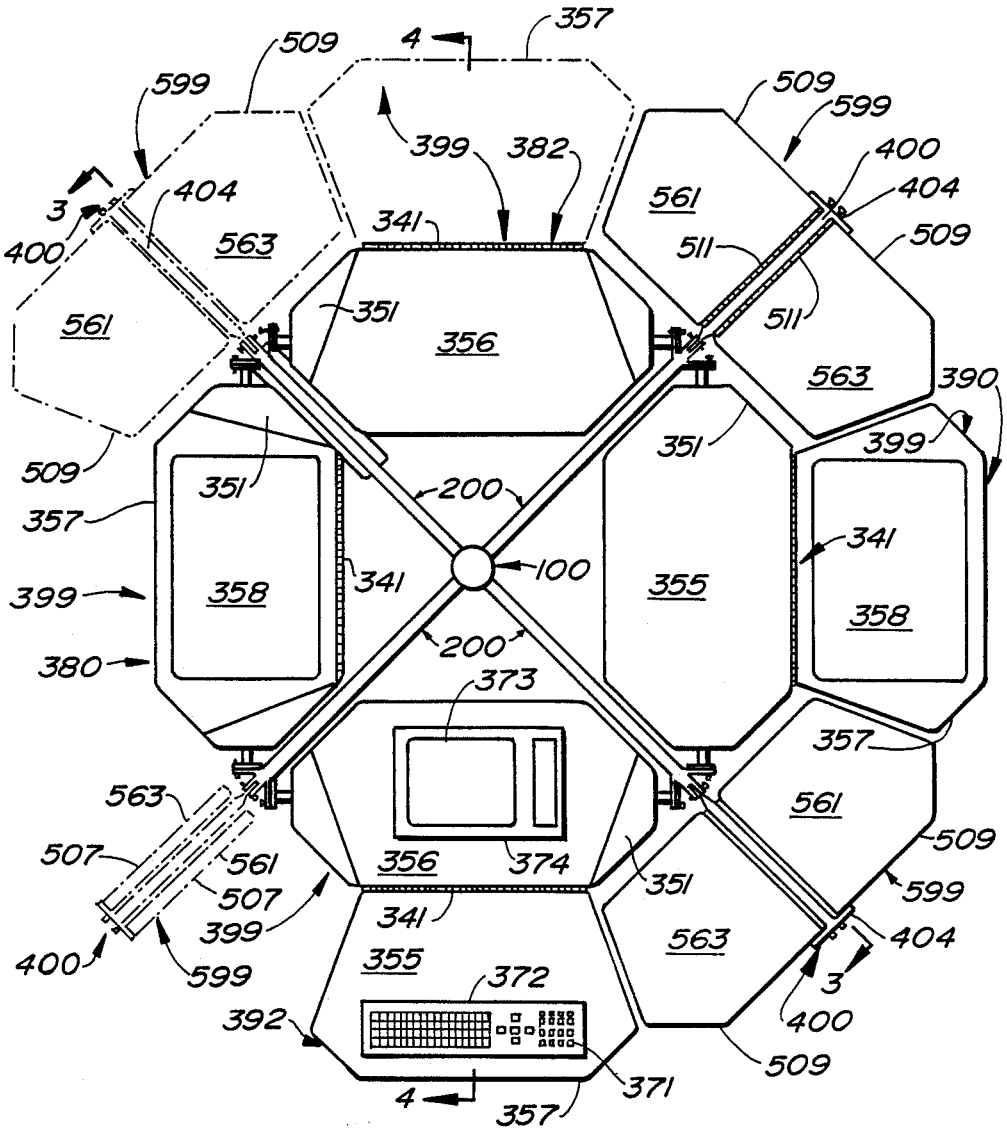
FIG. 10 is a top plan view of another embodiment of a wardroom table system in accordance with the invention.

The primary arm subassembly 200 attaches to the center post subassembly 100 at the gusset plates 151. The primary arm structure 201 is comprised of two parallel and identical cantilever plates 203 that attach to the gusset plates with removable pins or bolts 205 through holes 207 which correspond to the holes 153 in the gusset plates 151. The two structural cantilever plates 203 are held apart at a fixed distance by spacer blocks 209 at each end to create a gap. The parallel top edges 213 of plates 203 act as a track to which the crew can attach various apparati such as lights, hand hold restraints or equipment restraints. FIG. 1 shows such apparati attached to track 213. The spacer blocks 209 may be individual parts of they may be integrated into the function of the gusset plate 151 at the proximal end 215 and the bifucated arm extension 217 at the distal end 219 of primary support arm subassembly 200. The bifucated arm extension 217 is fixed to the cantilever plates 203. Two primary work surface brackets 227 are attached to the throat 229 of the bifucated arm extension 217 as shown in FIGS. 10 and 14.

PRIMARY WORK SURFACE SUBASSEMBLY

The primary work surface subassembly is illustrated in FIGS. 1, 10, 11 and 14. The primary work surface subassembly 300 is comprised of fixed and moving parts including the rotation wheel mechanism 301, the octagonal primary work surface 321, piano hinge 341 and the rectangular primary work surface extension leaf 327. Rotation wheel mechanism 301 consists of a rotating sleeve 303, a rotating stud 305 and two quick release marine type shear pins 309 and 361. The rotating stud 305 is attached to the edge o octagonal primary work surface 321 as best seen in FIG. 14. Sleeve 303 is free to rotate about the fixed stud 245 except that it may be locked into various rotational position by inserting a pin 361 through the alignable holes 363 in the wheel portion of sleeve 303.

The octagonal primary work surface 321 is shaped as a somewhat flattened octagon to permit it to rotate 360 degress through the space between.two adjacent primary support arm subassemblies 200. Various positions for work surface 321 are shown in FIGS. 1 and 7-11.

Work surface 321 has two faces, an active, contoured obverse face 323 and a passive, flat reverse face 325. The obverse face 323 incorporates a recess 326 into which the primary work surface extension leaf 327 stows and it may include other contoured recesses for installing special communications equipment, or food and beverage restraint receptacles. The primary work surface extension leaf 327 attaches to primary work surface 321 by a piano hinge 341 about which it can swing 180 degrees to that it is self-stopping against primary work surface 321.

SECONDARY SUPPORT ARM SUBASSEMBLY

The secondary support arm assembly 400 is shown in FIGS. 1 and 6-12. The secondary support arm subassembly 400 consists primarily of moving parts including the cambracket position locking mechanism 401, the secondary arm extension square tube 417, and the end plate locking mechanism 431. The secondary support arm subassembly 400 connects to the primary support arm subassembly at the bifurcated arm extension 217 where a dowel axle 403 passes through holes 222 in the two lobes 224 of 212 and the corresponding hole 422 in the cambracket cam 405. Dowel axle 403 is held into place by release pins 414 thorugh holes at each end of 403 and on either side of 217.

The rotary position of the cam 405 relative to the lobes 224 is secured by a quick release locking pin 407 that is inserted through holes 226 in the lobes 224 and through the corresponding alignable hole 426 in the cam 405. Cam 405 has two end lobes; a wide lobe 409 with two or more holes 426 in it for deploying the subassembly 400 at various angles and a narrow end lobe 411, with one hole 426 in it for securing subassembly 400 in stowed position. Cam 405 has a square plug end 413 which inserts into the proximal square end 415 of the square tube 417.

At the distal end 419 of square tube 417 is attached the end plate locking mechanism 431. This end plate locking mechanism 431 is used to determine the position of the secondary surfaces of subassembly 500. A square plug 433 projection of the end plate 435 inserts into the square opening of distal end 419. End plate 435 is trapezoidal in shape with locking pin holes in each of its four corners. These two pairs of holes correspond to the two locking positions of each of the leaves; right hand leaf 501 and the left hand leaf 503 of the secondary work surface subassembly 500. The pair of holes 441 at the narrow trapezoidal base end 443 of the end plate 435 correspond to the folded or stowed position 507 of the two leaves 501 and 503. The pair of holes 445 at the wide trapezoidal base end 447 of the end plate 435 correspond to the unfolded or deployed position 509 of the two leaves 501 and 503.

SECONDARY WORK SURFACE SUBASSEMBLY

The secondary work surface assemblies are illustrated in FIGS. 1 and 6-12. The secondary work surface subassembly 500 includes the right and left rectangular "butterfly leaves" or half tops 501 and 503 respectively, the piano hinges 511 and the left and right end locking tabs 531 and 533. For commonality and interchangeability of parts, tops 501 and 503 may be identical to the rectangular primary work surface extension leaf 327 in size and shape and means of attachment by a piano hinge.

The right leaf 501 and the left leaf 503 both attach to the secondary support arm square tube by means of piano hinges 511 by using machine screws 513. The screw heads of the machine screws (not shown) act as measured stops to control the maximum swing of the butts of the piano hinges 511 to 180 degrees. The minimum swing of the right two leaves 501 and 503 also have the end locking tabs 531 screwed to them where their locking pin holes 535 will align with the corresponding position holes 441 and 445 in the end locking plate 435. A quick release detent pin 551 is inserted through these holes when aligned to secure the right leaf 501 and the left leaf 503 in either the folded position 507 or the unfolded position 509.

OPERATIONAL MODES FOR INDIVIDUAL ADJUSTMENTS

The possibilities for individual adjustment of the wardroom table apparatus become apparent. The table is intended to be comfortable, compact and easy to use by each individual member of the crew. Comfort is achieved by the overall plan configuration which ensures good sightlines and vocal distances for all participants, and by the extending and angled surfaces which ensure compliance with the 5th-to-95th percentile anthropometric size range. Compactness is achieved by ensuring that the table surface positions fold away when not in use (assuming that only the 4 inner positions are regularly used by a single crew shift) to free as much volume as possible around the table for crew movement. Ease of use is achieved by ensuring that all mechanisms, controls and accessories are simple and obvious to use and that maintenance, repair and cleaning duties are as straightforward as possible.

PRIMARY WORK SURFACE ADJUSTMENT

The primary work surface assembly 300 serves crew shifts of all sizes, with or without the use of the secondary work surfaces.

Figure 9:
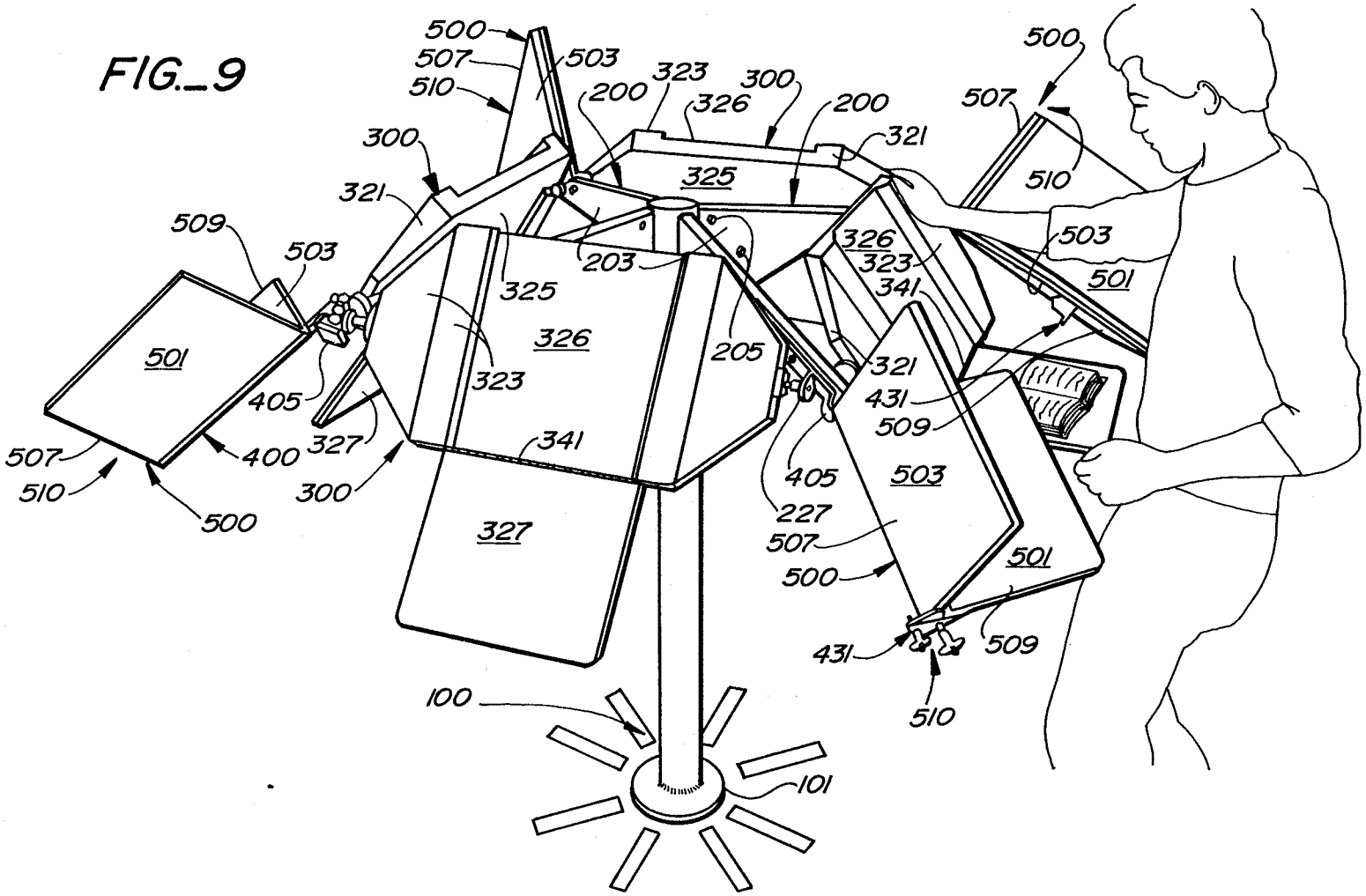
FIG. 9 is a perspective view of a portion of the wardroom table system in an arrangement for one crew member.

FIG. 9 shows the octagonal primary work surface 321 mounted to its rotation disk mechanisms at either end of its longitudinal axis. The crew members may adjust position of the octagonal primary work surface by manually removing the two quick release detent shear pins 361 (see FIG. 14) from the rotation disk mechanism, 301, rotating the octagonal primary work surface 321 to the desired angle and then replacing the pin. In FIG. 9, the primary work surface 321 is show rotated approximately 45 degrees and from the horizontal.

The crew may adjust the primary work surface subassembly 300 further by releasing the rectangular primary work surface extension leaf 327 from its recess 326 in the obverse face 323 of the octagonal primary work surface 321 and swinging it into the desired position. The crew members secure the extension leaf 327 into position by tightening the captive set screw and slotted slide device on the side edges of the extension leaf. In FIG. 9, the extension leaf in useby a crewmember is shown deployed at an angle of about 150 degrees from the octagonal primary work surface 321 itself.

SECONDARY WORK SURFACE ADJUSTMENT

The deployment and stowage operation of the secondary work surface subassembly 500 is more complex than that of the primary work surface subassembly 300 because it must stow completely out of the way of the smaller crew shift whereas the primary work surface subassembly 300 is always accessible and available for use. The secondary work surface subassembly 500 will be used principally when the primary work surfaces are already occupied by other crew members.

Figure 6:
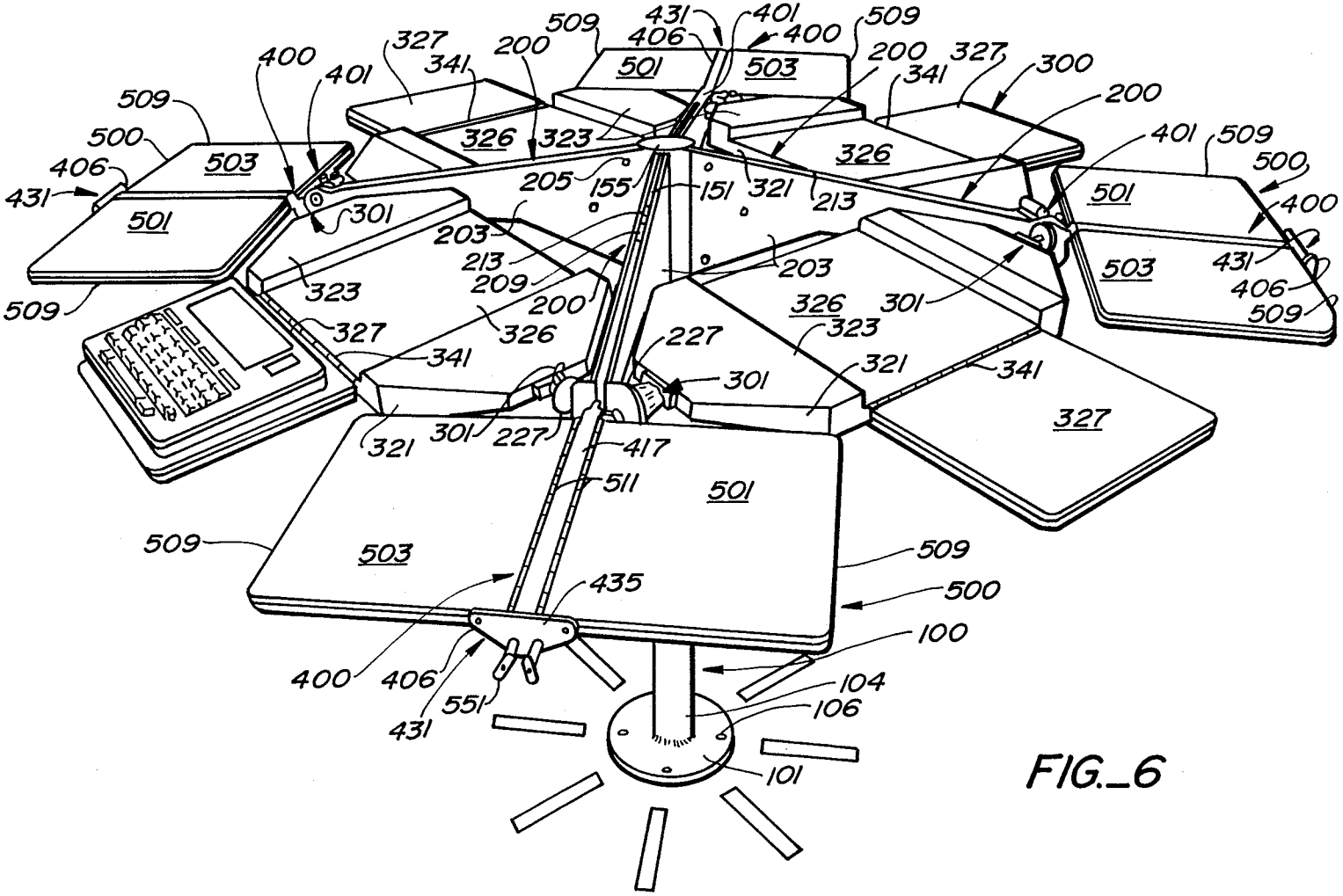
FIG. 6 is a perspective view of the wardroom table system in another arrangement for four crew members.

FIG. 6 shows the secondary work surface in stowed position beneath the primary support arm. In this stowed position, the two "butterfly" leaves or half-tops 501 and 503 are folded at the piano hinges which attach then to the secondary support arm. Referring now to FIG. 14 the cambracket 405 is plug connected into the end of the secondary support arm square tube. In this deployed position 404, the narrow lobe 411 of the cambracket (shown in FIG. 14) with one hole in it upward points to align with the two corresponding holes in the bifurcated arm extension 217. Below the bifurcated arm extension wide lobe 409 of cambracket 405 is visible with three alignment holes (426) for the various possible deployment positions 404 and 406 of the secondary support arm. The cambracket and the secondary support arm subassembly 400 and the secondary work surface subassembly 500 rotate about dowel axle 403 which passes through the rotation center point of bifurcated arm extension 217.

Note that when second and work surface subassembly 500 is rotated to the stowed position, the positions of the narrow and wide lobes of the cambracket will be reversed.

FIG. 14 shows both the secondary support arm subassembly 400 and the secondary work surface subassembly 500 fully unfolded, opened and deployed. The back edges of piano hinges 511 are visible longitudinally along the square tube 417 of the secondary support arm, and in fact the two butts of each of the piano hinges 511 are pressed together in a self-stopping closed position. At the outermost end of the secondary support arm, the end plate locking mechanism 431 is fully visible, with the two secondary work surface position pins 551 visible in the lower locking position holes 441 alignment holes, securing the tops into the open position and the upper locking position holes 445 are empty.

WORKBENCH MODE

Figure 5:
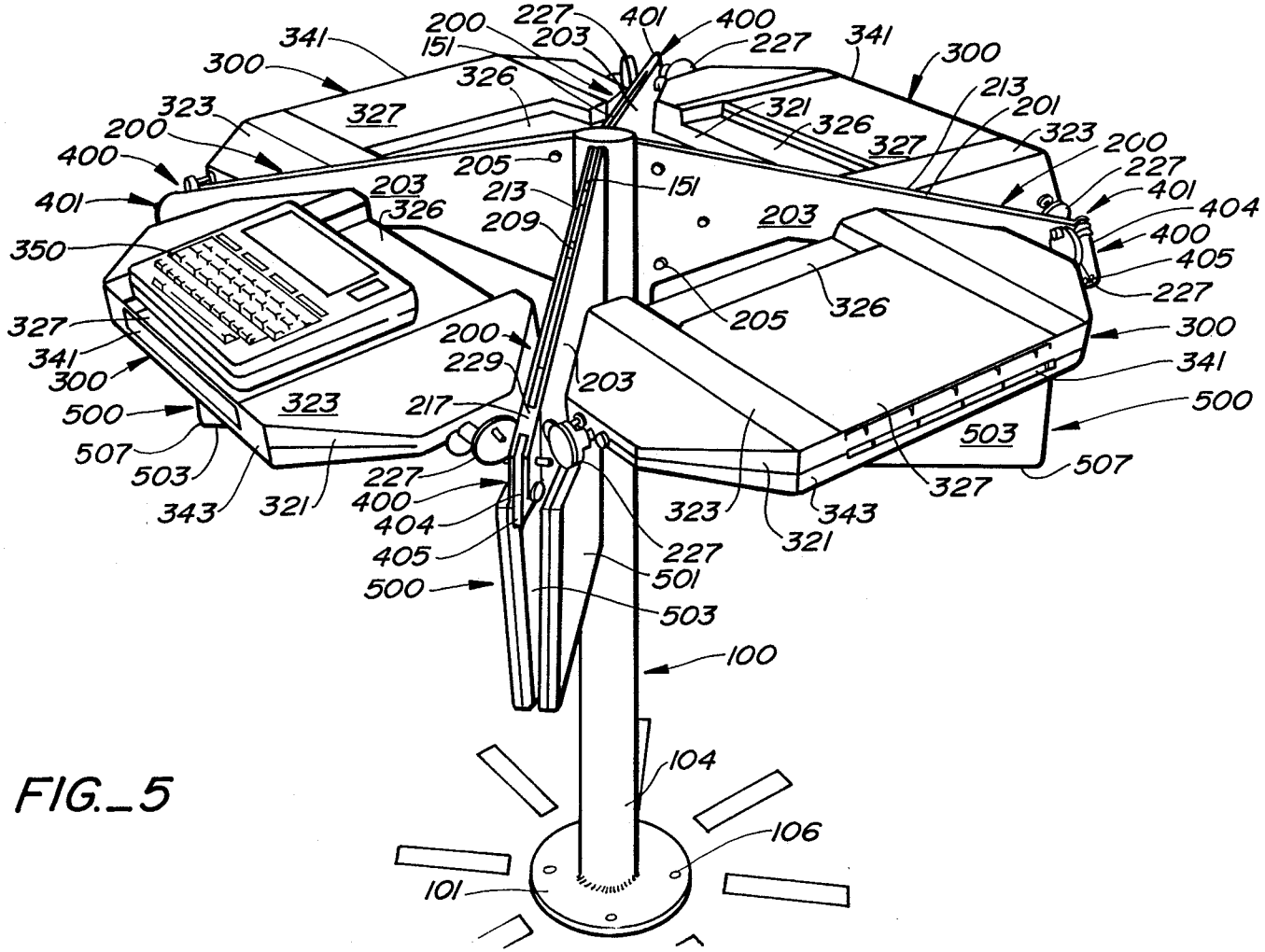
FIG. 5 is a perspective view of the wardroom table system in an arrangement for four crew members.

FIG. 5 shows the wardroom table system configured in "work bench" mode for a crew of four people. In this mode, the four primary work surfaces all are arranged in horizontal rotation positions so that the overall table top is as flat and horizontal as possible. All of the primary work surface 321 extension leaves and of the secondary work surface assemblies are stowed completely to provide for a flat and fairly compact workbench. A small portable computer is restrained to the backside 350 of the stowed secondary extension leaf 327. The work surface arrangement of FIG. 5 would accommodate a group of two to four space crew members eating a meal together or working with the same materials, documents or equipments, when the crew members need a common reference and restraint surface in the microgravity environmnent. The wardroom table arrangement of FIG. 5 provides a small degree of temporary personal space and personal territory to crew members as their positions are defined implicitly by the diagonal positions of the primary support arm subassemblies 200 and the primary work surface subassemblies 300.

TRAINING MODE

Figure 7:
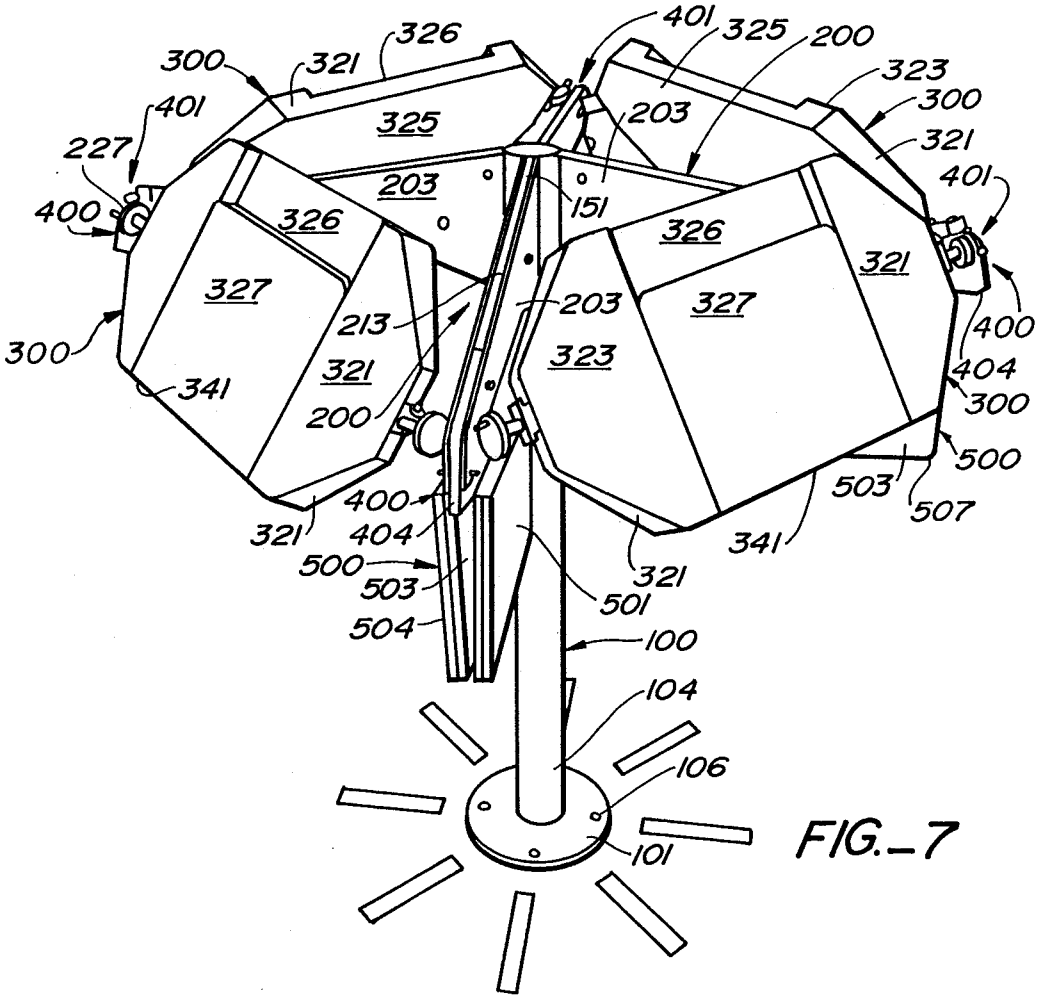
FIG. 7 is a perspective view of the wardroom table system in an arrangement for eight crew members.
Figure 4:
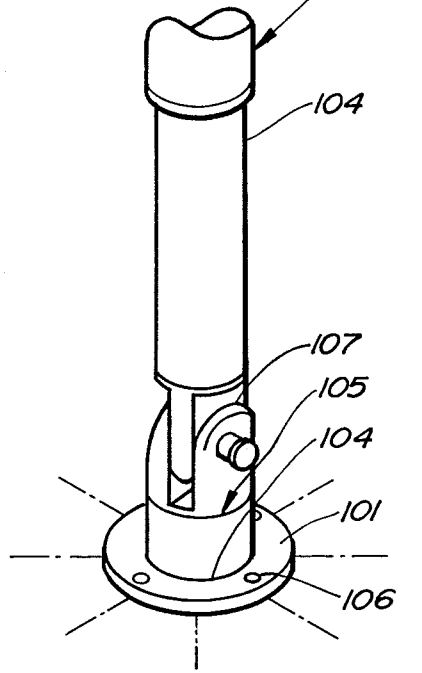
FIG. 4 is an enlarged, partial isometric view of a portion of the wardroom table system shown in FIGS. 1–4.

FIG. 7 shows the wardroom table system arranged in "training" mode, which is similar to the arrangement described in FIG. 5 with one significant change. The crew members have rotated the primary work surface assemblies 300 about 65 degrees from the horizontal. In this arrangement, the worksurfaces are especially oriented to accommodate the visual sightline requirements for humans working in microgravity such that the neutral body that the human body assumes when experiencing the effects of "weightlessness" causes the sightline from the human eye to drop about 23 to 27 degrees below the horizon line. Thus, with the work surface tops oriented at 65 degrees from the horizontal, any object such as a document or computer restrained to said surface face 323 will be approximately orthagonal to the sightline of a space crew member with his or her feet in the inner ring of foot restraint pairs 82 shown in FIG. 1 and who assumes the neutral body posture of the microgravity environment. The wardroom table system arrangement shown in FIG. 7 also provides a small degree of personal space and personal territory as similar to that shown in FIG. 13, but the arrangement of FIG. 7 also offers a small degree of temorary privacy as none of the crew members restrained in positions at the primary work surfaces 323 and 327 can easily see the objects or materials restrained to the primary work surfaces 323 and 327 of the other three crew positions.

CONFERENCE MODE

FIG. 6 shows the wardroom table system 1 in another variation of the arrangement of the configuration shown in FIG. 5. In FIG. 6, the crew members have unfolded, extended and deployed all the rectangular leaves of both the primary work surface assemblies 300 and the secondary work surface assemblies 500. As in FIG. 13, all these work surfaces are positioned to share a common horizontal reference plane and as such constitute an extension of "work bench" mode into "conference" mode. Conference mode as shown in FIG. 6 accommodates up to eight space crew members around the wardroom table system 1 in a manner that optimizes direct eye contact and interpersonal communication. Conference mode provides a level and equal meeting place for all the space crew members to gather to discuss activities, socialize or share meals. Like the workbench mode of FIG. 13, the conference mode provides a small degree of temporary personal space and territory which are suggested implicitly by the triangular gaps between the primary work surface extension leaves 327 and the secondary work surface subassembly 500 around the outer perimeter of the table system.

PLANNING MODE

FIG. 8 shows the wardroom table system 1 arranged in "planning" mode during which the full complement of eight crew members must make extensive use of documents and possibly computer systems so that it is desirable to optimize the ergonomics of neutral body posture for visual sightlines to the work surfaces. Planning mode is a variation of the conference mode shown in FIG. 6 in which the crew members have totaled the work surfaces to angles of approximately 45 degrees which offer a compromise between the optimal sightlines or view angles for discussions between crew members and the crew members' use of the work surfaces in the microgravity environment. Like the training mode shown in FIG. 7, planning mode offers a small degree of temporary personal space, territory and privacy to the crew members.

INDIVIDUAL WORK STATION MODE

FIG. 9 represents the wardroom table system 1 in "individual work station" mode, a special adaptation of the planning mode shown in FIG. 8. Temporary individual work station mode occurs when a space crew member adapts to his or her use two or more of the work surface positions of conference mode. FIG. 9 shows a space crew member who has configured three work surface positions for his transitory personal use, specifically one primary work surface subassembly 300 which he is facing as he adjusts the primary work surface extension leaf's 327 position, and the two secondary work surface assemblies 500 which are already deployed on either side of him from planning mode. The crew member has customized or personalized further the ergonomic features of his temporary individual work station arrangement by adjusting the position of the outer half tops, 501 to his right and 503 to his left, in each of the adjacent secondary work surface assemblies. The crew member has moved these two outer half tops into folded or stowed positions 507 so that they form a right angle with the other two tops in unfolded position 509. This "el" arrangement 510 of the two pairs of half tops gives the crew member added convenience and functionality for his temporary individual work station to attach equipment, materials or documents where he can easily see or reach them. This temporary individual work station mode affords the crew member the a greater degree of temporary personal space, territory and privacy that the other modes described in FIGS. 5–8.

ALTERNATE EMBODIMENTS OF THE INVENTION

Figure 11:
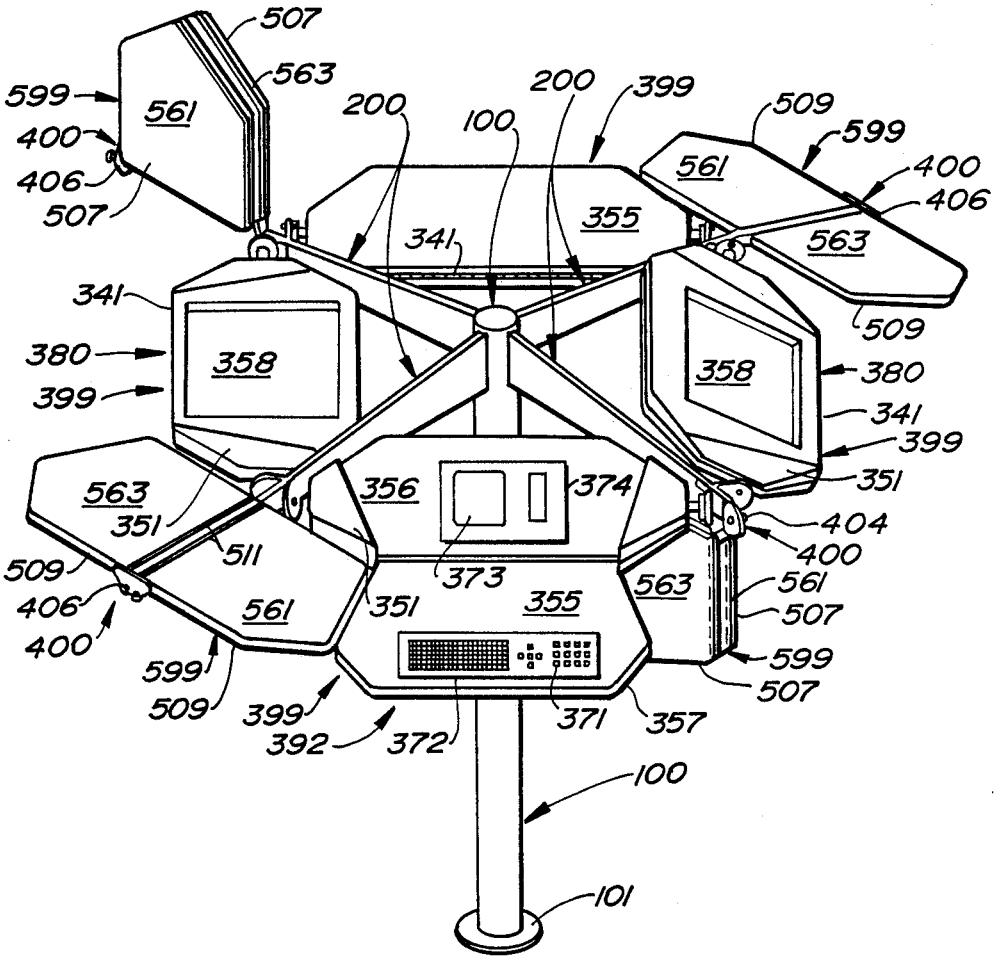
FIG. 11 is an isometric view of the wardroom table system of FIG. 10.

An alternate and optimal embodiment of the invention is illustrated in FIGS. 10–11 and 14, which show a different pattern for the primary and secondary work surfaces. In this alternate embodiment, the rectangular primary work surface extension leaves 327 and rectangular secondary work surface top halves 501 and 503 are replaced by a system of larger, hexagonal tops. These larger hexagonal tops provide several advantages over the simpler rectangular tops. The hexagonal tops provide a more consistent and uniform outside perimeter edge to the table in the eight crew member configuration, a larger work surface area, identical crew stations for each of the eight members of the full crew at the wardroom table and a geometry which is more harmoniously integrated.

A further advantage of this alternate embodiment configuration is that it takes more full advantage of the 360 degree rotation capability of the octagonal primary work surfaces. It allows the food restraint devices or receptacles that are potentially part of the extension leaf to be usable equally in both the four crew member and the eight crew member configurations. The arrangements of this alternate embodiment also make a clear distinction between surface tops that are to be used for eating meals and the opposite sides of those same surface tops that are used as part of work stations.

When the alternate embodiment primary work surface assembly 399 is to be used for meals in the four crew configuration (right side of FIG. 12) 380, it is rotated so that the piano hinge 341 faces toward the center post and the food restraint surface 358 of the hexagonal extension leaf 357 faces upward while the leaf remains folded into the corresponding recess 358 in the octagonal primary work surface 351. In this configuration 380, the food restraint surface 358 is conveniently accessible to crew members using the inner ring of four pairs of foot restraints.

When the primary work surface subassembly 399 is to be used for meals in the eight crew configuration 390, it is rotated 180 degrees so that the piano hinge 341 faces away from the center post and the food restraint surface 358 of the hexagonal extension leaf 357 faces down while the leaf 357 remains folded into the corresponding recess 356 in the octagonal primary work surface 351. Then the crew member releases a catch or detent locking device and swings the hexagonal primary work surface extension leaf 357 on the piano hinge 341 up to 180 degrees out of its recess 356 and locks it into the desired configuration 390 using the slotted slide and captive set screw device. In this configuration 390, the food restraint surface 358 is conveniently accessible to crew members using the outer ring of eight pairs of foot restraints.

Figure 12:
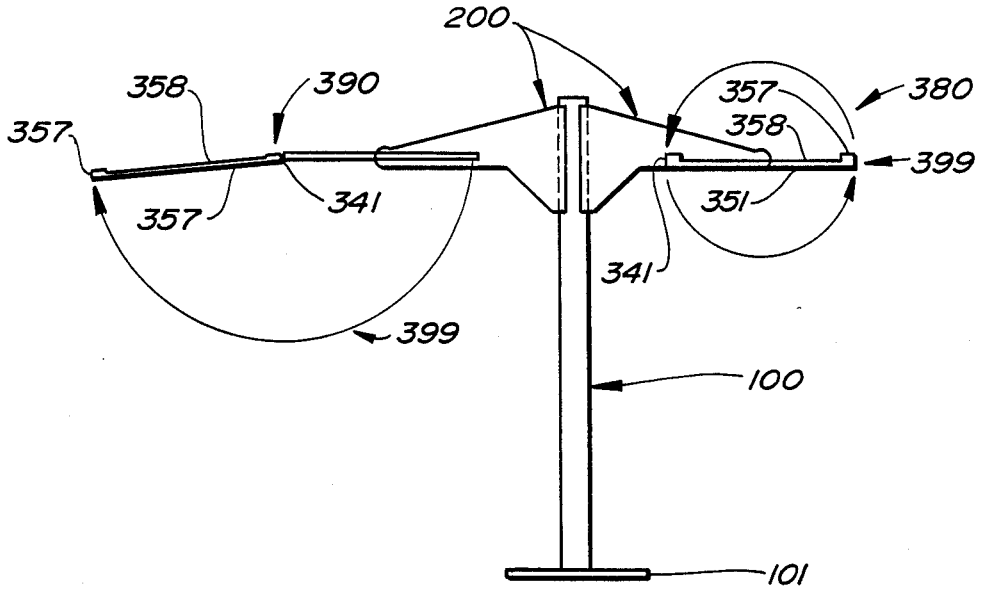
FIG. 12 is a side cross section view of the wardroom table system of FIGS. 10 and 11.
Figure 13:
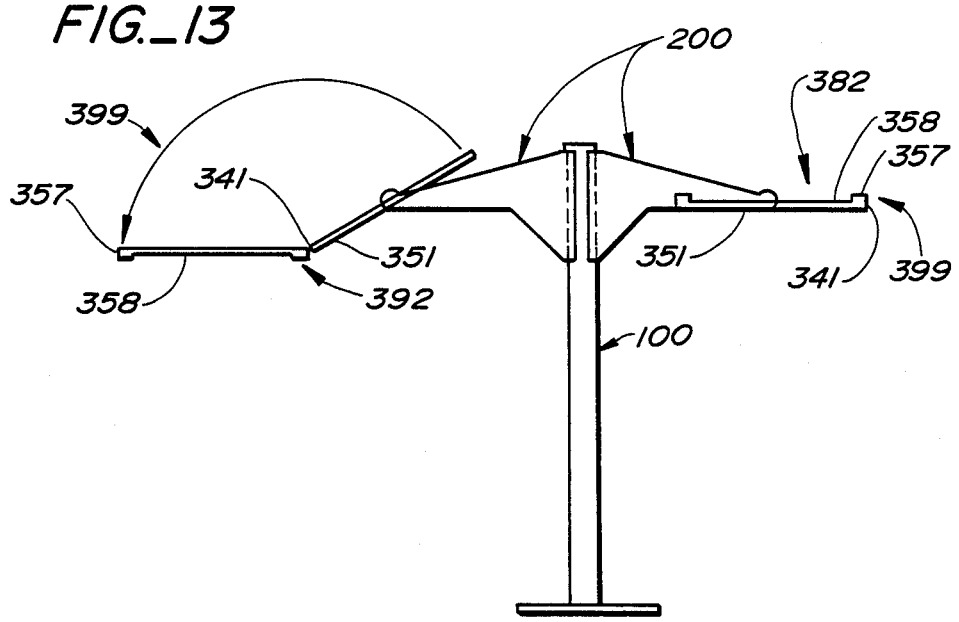
FIG. 13 is a side cross section view of another arrangement of the alternate embodiment of FIGS. 10–12.

As best seen in FIGS. 12 and 13, when the primary work surface subassembly 399 is to be converted from use as a food restraint configuration 380 or 390 to use as a work station or integrated computer terminal operation, the crew member can rearrange it by unlocking the rotating sleeves 303 from the rotation studs 305 at both of the axial ends of the primary work surface assembly 399. Then the crew member simply turns the work surface 351 around to reverse the positions of the rotation studs 305 at the two ends of the primary work surface assembly 399 and then reconnects them to the opposite rotation sleeves 303. After this readjustment to the folded work station configuration 382, the piano hinge 341 faces away from the center post and the food restraint surface 358 which is integrated into the hexagonal extension leaf 357 faces up. Then the crew member releases a catch or detent allow the hexagonal extension leaf 357 to swing on the piano hinge 341 up to 180 degrees out of its recess 356 in the octagonal primary work surface 351 so that the food restraint surface 358 faces down and the flat work surface 355 or recessed keyboard 371 faces up to form the unfolded work station configuration 392. The crew member with his feet in the outer ring of pairs of foot restraints can now see and conveniently use the flat panel computer video display terminal 372 which may be installed in a recess 374 in the octagonal primary work surface 351 and the keyboard 371 which is on the backside of the food restraint surface of the same hexagonal extension leaf.

In this alternate embodiment, when the food restraint surface is in use, the computer terminal and keyboard installed in these panels are protected by the arrangement of panels and leaves as follows: When in the four crew member configuration 380, the hexagonal extension leaf 357 is folded into its corresponding recess in the octagonal primary work surface 351, which corresponds to the workbench mode of FIG. 5. In this alternate embodiment of the workbench mode that the flat panel video display terminal 373 and the associated keyboard 371 are both protected and hidden and are shielded directly from spills of food or drink or inadvertent impacts. When in the eight crew member configuration 390, corresponds to the conference mode shown in FIG. 6, the flat panel video display terminal 373 and the keyboard 371 are both positioned on the opposite sides of the work surface that are in use and are thus shielded indirectly from spills of food or drink or inadvertent impacts. Since diurnal crew shifts of four crew members will use the wardroom table in groups of four for probably 2/3 of all meals, the superior protection of the 4 crew configuration will be available most of the time.

The alternate embodiment secondary work surface half tops 561 and 563 of the alternate embodiment secondary work surface subassembly 599 also take advantage of the hexagonal extension leaf geometry to create the wardroom table perimeter edge with minimal gaps or spaces between surfaces. To create the secondary work surface halves 561 and 563, the basic hexagonal extension leaf 357 is cut in half and a small strip of material removed from both of the cut halves to leave room for the secondary support arm square tube 417 to which the plane hinges 511 and end plate locking mechanism 431 will be attached.

Advantages of the Invention Over Prior Art

This design approach replaces the conventional concept of a unified table surface with a group of independent surface elements which can be rotated, unfolded and angled to suit a wide range and mixture of operational anthropmetric and ergonomic requirements for space station or other space craft crew members in the microgravity environment. Virtually every feature described above that goes beyond a fixed, flat rectangular table surface is an advantage over the prior art.

What is claimed is:

1. A table top for use in constricted areas comprising:

(a) a plurality of support arms each having an inner end and a distal end, said inner ends substantially abutting to form a hub and said distal ends arranged in equidistant, spaced-apart relation to each other;

(b) a plurality of work surface leaves each having a pair of leaf sections, each leaf being positioned between two of said support arms and being foldable onto itself to provide a polygonal flat work area in the folded position and being unfoldable;

(c) a plurality of distal leaves each having a pair of sections, and a plurality of foldable junctions each pivotally joining the pair of sections of a distal leaf to allow the sections to pivot between an unfolded position away from one another and a folded position against one another, each foldable junction being coupled to the distal end of one of said arms.

2. The table top of claim 1 further comprising:

support means for supporting said table top in an elevated position.

3. The table of claim 2 wherein:

said support means comprises a center post on which said arms are mounted.

4. The table top of claim 1 wherein said junctions support said distal leaves in pivotal movement between an upright position wherein said distal leaf sections are unfolded and lie level with said support arms and a stored position wherein said distal leaf sections lie against one another and below said support arms, and means for holding said work surface leaves and said distal leaves in their unfolded positions, said work surface leaves and distal leaves forming an expanded generally circular flat work area in their unfolded positions.

5. The table top of claim 4 wherein:

said work surface leaves each lie between a pair of said support arms and are pivotally attached to the corresponding pair of support arms.

6. The table top of claim 4 wherein said foldable junctions each comprises a hinge connecting a pair of distal leaf sections, and also comprises a cambracket connecting the distal end of one of said support arms and one of said hinges, each of said cambrackets being rotatable about 180° to permit a distal secondary work surface leaf to stow beneath said support arms.

7. The table top of claim 6 wherein the distal end of each of said arms has a part pivotally connected to a corresponding cambracket, the arm part having a hole and the cambracket having a plurality of holes that are each alignable with said arm part hole at a different pivot position of said cambracket on said distal arm part, and including a pin formed for removable insertion into said hole in said distal arm part and one of said holes in said cambracket.

8. The table top of claim 4 wherein said work surface leaf sections and said distal leaves are configured so when they are all in their unfolded positions they form a substantially continuous perimeter edge to said table top without substantial interrupting gaps or spaces.

9. An expandable table comprising:

(a) a plurality of support arms each having an inner end and a distal end, said inner ends substantially abutting to form a hub and said distal ends arranged in equidistant, spaced apart relation to each other;

(b) a center post attached to said hub formed by said arms to provide a support for said arms;

(c) a plurality of primary work surface leaves each being mounted between two of said arms and having a pair of leaf sections that can be pivoted between folded and unfolded positions and that provide a polygonal flat work area in the folded position;

(d) a plurality of secondary work surface leaves, each having a pair of leaf sections and a junction that pivotally connects said secondary leaf sections to allow them to pivot between folded and unfolded positions, the junction of each leaf section being attached to the distal end of one of said arms;

(e) said junctions support each secondary leaf in pivoting between an upright position level with said arms and a stored position below said arms; and (f) said primary and secondary leaves form an expanded polygonal flat work area in their unfolded positions.

10. The table of claim 9 wherein said center post further comprises upper, lower, and middle parts, an upper joint connecting said upper and middle parts, and a lower joint connecting said lower and middle parts, said joints permitting said upper and lower parts to each pivot between positions in line and out of line with said middle part, whereby to allow said center post to fold to stow out of the part of large objects.

11. The table of claims 9 wherein said center post is formed with a telescoping portion.

12. The table top of claim 9 wherein said work surface leaf sections each have opposite ends pivotally mounted to one of said arms and each leaf section can pivot 360° about an axis extending between its opposite ends.

13. The table top of claim 9 wherein one primary work surface leaf section of each pair has a recess for receipt of the other leaf section of the pair.

14. A table top for use in constricted areas comprising a plurality of support arms each having inner ends substantially abutting to form a hub and having opposite distal ends arranged in equidistant, spaced-apart relation to each other;

a plurality of work surface leaves, each leaf being positioned between the distal ends of two of said support arms;

said support arms having upper ends and each leaf having opposite ends pivotally connected to the distal end of a corresponding support arm to allow the leaf to pivot at least about 180° about an axis extending between its ends and to lie at substantially the same level as said arms.

15. The table top of claim 14 wherein each leaf includes first and second leaf sections, the first leaf section having a recess for receipt of the corresponding second leaf section.

16. The table top of claim 14 additionally comprising a plurality of distal leaves, each distal leaf having a pair of leaf sections and a junction pivotally connecting a corresponding pair of distal leaf sections to allow them to fold together each distal leaf being attached to the distal end of one of said arms at said leaf's junction.

17. A table top for use in constricted areas comprising:

a hub;

a plurality of support arms radiating from said hub and having distal ends further from said hub and arranged in equidistant, spaced-apart relation to each other;

a plurality of work surface leaves each mounted between a pair of support arms; and a plurality of distal leaves, each attached to the distal end of one of said arms.

18. The table top of claim 17 wherein said distal leaves are pivotable between an upright position level with said support arms and a stored position below said support arms.

* * * * *